US006575200B2

(12) United States Patent
Van Geluwe et al.

(10) Patent No.: US 6,575,200 B2
(45) Date of Patent: Jun. 10, 2003

(54) WEAVING MACHINE AND METHOD FOR MANUFACTURING FABRICS WITH PATTERN-FORMING WEFT THREADS SUCH AS KELIM OR GOBELIN FABRICS

(75) Inventors: Jacques Van Geluwe, deceased, late of Waregem (BE), by Philip A. M. J. L. Van Geluwe, legal representative; by Harald A. S. Van Geluwe, legal representative, Oostrozebeke (BE); by Kristina H. S. Van Geluwe, legal representative, Oostrozebeke (BE); by Elisah M. B. Van Geluwe, legal representative, Oostrozebeke (BE); by Marie-Anne J. J. A. A. Van Geluwe, legal representative, Wortegem-Petegem (BE)

(73) Assignee: Robosoft N.V., Ieper (BE); part interest ( * ) Notice: Subject to any disclaimer, the term of this patent is extended or adjusted under 35 U.S.C. 154(b) by 0 days.

(21) Appl. No.: 09/951,079

(22) Filed: Sep. 13, 2001

(65) Prior Publication Data

US 2002/0092579 A1 Jul. 18, 2002

Related U.S. Application Data

(63) Continuation of application No. 09/674,687, filed as application No. PCT/EP99/02760 on Apr. 19, 1999.

(30) Foreign Application Priority Data

May 5, 1998 (BE) ..... 9800332

(51) Int. Cl.[7] ..... D03D 41/00
(52) U.S. Cl. ..... 139/11; 139/116.1; 139/55
(58) Field of Search ..... 139/11, 116.1, 139/453, 55

(56) References Cited

U.S. PATENT DOCUMENTS

| | | | | |
|---|---|---|---|---|
| 3,731,712 A | * | 5/1973 | Sermet | 139/55 |
| 3,782,421 A | * | 1/1974 | Budzyna | 139/122 W |
| 3,791,418 A | * | 2/1974 | Pfarrwaller | 139/122 R |
| 3,951,177 A | * | 4/1976 | Santucci | 139/122 |
| 4,313,427 A | * | 2/1982 | Weidmann | 139/370.2 |

* cited by examiner

*Primary Examiner*—A. Vanatta
*Assistant Examiner*—Robert H. Muromoto
(74) *Attorney, Agent, or Firm*—Maria Parrish Tungol; John A. Parrish

(57) ABSTRACT

A weaving machine for manufacture of a fabric comprising a shed-forming device for forming a shed of warp threads, a selection device 22 comprising at least one rotatable element and a plurality of thread holders 31 for transmitting weft thread there through, the thread holders, being positioned in a row, whereby rotation of the rotatable element 25,26,27,28 causes said row to move for supply of weft thread to a desired position for manufacture of a fabric. The weaving machine of the present invention includes a weaving sley comprising a selection device 22 for supply of weft thread during manufacture of a fabric, a weft insertion mechanism operatively connected to the sley and movable relative to the selection device 22. A method of manufacture of a fabric having weft threads comprising, forming a shed from a plurality of warp threads, and supplying a weft thread to the shed by a selection device 22, said selection device comprising at least one rotatable element 25,26,27,28 and a plurality of thread holders 31 for transmitting weft thread there through, the thread holders being positioned in a row whereby rotation of the rotatable element causes the thread holders to move to a desired position for supply of weft thread to the shed.

21 Claims, 12 Drawing Sheets

WEAVING MACHINE AND METHOD FOR MANUFACTURING FABRICS WITH PATTERN-FORMING WEFT THREADS SUCH AS KELIM OR GOBELIN FABRICS

This application is a continuation of U.S. application Ser. No. 09/674,687, filed Nov. 3, 2000, which was the National Stage of International Application No. PCT/EP99/02760 filed on Apr. 19, 1999.

International Application No. PCT/EP99/02760 was published in English on Nov. 11, 1999.

This invention relates to a weaving machine, comprising a shed-forming device provided in order in successive operating cycles to form a shed between a part of the warp threads provided on the weaving machine, a selection device provided in order in every operating cycle to select a weft thread from a number of different weft threads, and a weft thread mechanism provided in order in each case to insert and cut off the necessary length of the selected weft thread in the shed, so that a fabric is formed in which weft threads only extend over a part of the fabric width and are pattern-formingly inwoven by warp threads.

Kelim and Gobelin fabrics consist of warp threads and weft threads. The weft threads are inwoven in such a manner by the warp threads that they have running parts along the top of the fabric which cover the warp threads. These visible parts of the various weft threads together form a pattern. It is also characteristic of these fabrics that in one and the same weft line different color areas of the pattern are formed by respective weft thread parts (with a different color), which only extend over a part of the fabric width. Moreover it is typical for these fabrics (in particular for Gobelin fabrics) that the pattern consists of a great number of different colors.

In the Belgian patent no. 1004414A3 (patent application no. 9000586) a weaving machine is described which has the characteristics mentioned in the first paragraph of this specification.

The selection device of this known weaving machine comprises a color grating in which the various weft threads can be provided in several rows next to one another. This color grating can be moved both in warp direction and in weft direction in order in every operating cycle to bring (to select) a specific weft thread (in function of the pattern to be formed) to a selection position so that it can be brought into the shed by a rapier.

Since this color grating must be able to be moved according to two different, mutually perpendicular, directions, two drive devices must be provided. Such a selection device operates rather slowly and is furthermore also complex and expensive.

The purpose of this invention is to provide such a weaving machine with a selection device which does not have the above mentioned disadvantages.

This purpose is achieved according to this invention by a weaving machine with the characteristics mentioned in the first paragraph of this specification, whereby the various weft threads can be provided in one row in the selection device, and whereby the selection device comprises at least one rotatable element which is provided in order, through its rotation, to move the aforesaid row for the selection of a weft thread.

With such a selection device one single driving means is sufficient in order to rotate the rotatable element to such a position that one of the various weft threads is selected (brought into a selection position). Such a rotating driving means, such as for example an electric motor, works faster, and is also much simpler and less expensive than the two linearly moving driving means of the known weaving machine.

Another aspect of this invention relates to a method for manufacturing a fabric with pattern-forming weft threads on a weaving machine, such as for example a Kelim or Gobelin fabric, whereby in successive operating cycles a shedforming device is operated in order to form a shed between a part of the warp threads provided on the weaving machine, whereby in every operating cycle a selection device is operated in order to select a weft thread from a number of different weft threads, and whereby in every operating cycle a weft mechanism is operated in order to insert and cut off the necessary length of the selected weft thread in the shed.

The method known from the above mentioned Belgian patent, has the properties which are mentioned in the preceding paragraph of this specification, but has the disadvantage that for the selection of a weft thread two different drive devices have to be operated.

A purpose of this invention is also to provide such a method, which simplifies the operation for the selection of a weft thread.

This aim is achieved by utilizing a method according to this invention, whereby the various weft threads are provided in one row in a selection device with at least one rotatable element which is provided in order, through its rotation, to move the aforesaid row for the selection of a weft thread.

According to this m method for the selection of a weft thread only the operation of a rotating driving means is required. This is considerably simpler that the operation of two linearly moving driving means.

Moreover this invention also relates to the fabrics manufactured according to the above method, in particular Kelim and Gobelin fabrics.

In a preferred embodiment of the weaving machine according to this invention the rotatable element is provided in order move the row of weft threads according to a closed path. Because of this a rather long row of weft threads can be provided —whereby the row for example forms a circle —while every weft thread can nevertheless be brought in a fast and efficient manner into a selection position, and while the space that this row occupies remains restricted. Another advantage of this embodiment is that the rotating element for each selection can be rotated according to the same direction of rotation. By allowing the rotating element to rotate according to one direction of rotation or the other, independently of the position of the weft thread to be selected in relation to the selection position, the operating speed can still be increased.

The row of weft threads is preferably so provided that the row can be carried by at least one end less carrier, which can be rotated by the rotatable element.

The selection device and the weft mechanism of the weaving machine according to this invention are preferably provided on one and the same positioning device which can be moved in the weft direction. Because of this through the operation of one driving means both the selection device and the weft mechanism can be positioned.

This weft mechanism in a very preferred embodiment of the weaving machine also comprises a gripping means which, in relation to the aforesaid positioning device, is movable in the weft direction, while it is provided in order to carry a weft thread selected by the selection device and, through its movement in relation to the positioning device, bring it into the shed.

The weft mechanism preferably also comprises a cutting means that is provided in order to cut through the weft thread brought into the shed between the shed and the selection device.

A particular embodiment of the weaving machine according to this invention comprises a weaving reed that is provided in order to remain in a fixed position during the weaving, while the weaving machine is provided with a construction which can move back and forth in warp direction which can move back and forth the last formed fabric part together with the (parts of the) warp threads extending from this fabric part through the reed in order to beat up one or several inwoven weft threads against the already formed fabric part.

With the method according to this invention the beating-up of one or several inwoven weft threads against the already formed fabric part is also preferably performed by moving toward this reed the last formed fabric part together with the (parts of the) warp threads running from this fabric part through a reed of the weaving machine, while the reed stands still.

On a weaving machine of which the reed performs a back and forth movement in order to beat up the weft threads the space in the vicinity of the reed must remain free in order to enable the movements of the reed. The fact that the weaving machine according to this invention has a reed that can remain in a fixed position during the weaving makes it possible to dispose the selection device and the weft mechanism in an ideal location, in the vicinity of the reed.

The shed-forming device, the selection device and the weft mechanism of another very preferred embodiment of the weaving machine can be so operated that in every operating cycle a shed is automatically formed between specific warp threads, a specific weft thread is selected, and a specific length of the selected weft thread is brought into the shed, whereby these warp threads, this weft thread and this length are in each case so determined that the weft threads are inwoven by the warp threads and form a predetermined pattern in the fabric.

With the implementation of the above described method according to this invention the shed-forming device, the selection device and the weft mechanism are preferably operated in the manner mentioned in the preceding paragraph.

The weaving machine is preferably also provided with a data processing unit, and with input means for inputting pattern data into this unit which determine the pattern to be formed, while this data processing unit is provided in order to determine the operating data or operating signals from these pattern data which are required for operating the shed-forming device, the selection device and the weft mechanism.

This data processing unit can for example be a computer, into which the pattern data can be input, for example by inputting an image of the pattern to be formed via a scanner connected to the computer. It that manner the operating data which are required for manufacturing a fabric with that pattern on the weaving machine are obtained in a particularly simple and fast manner.

When utilizing the method according to this invention use will preferably be made of a weaving machine which is provided with such a data processing unit—such as e.g. a computer—, pattern data, which determine the pattern, are input into this unit—e.g. by means of a scanner—, and this unit is provided—e.g. programmed—in order to determine the operating data or operating signals from these pattern data which are required for operating the shed-forming device, the selection device and the weft mechanism.

With handmade Kelim and Gobelin fabrics every weft thread is pattern-formingly inwoven from one extremity—which protrudes along the bottom side of the fabric—by a number of successive warp threads (located one next to the other), and the weft thread after passing around the last warp thread runs back to the first warp thread, where the other extremity of the weft thread protrudes next to the first mentioned extremity along the bottom side of the fabric. Because of this gaps are visible between the neighboring pattern-forming parts of weft threads inwoven in one and the same weft line. This is considered as a typical characteristic of handmade Kelim and Gobelin fabrics.

In order to achieve this typical characteristic with the fabrics which are manufactured by utilizing the method according to this invention, every weft thread is preferably inwoven on both sides of a pattern-forming part by warp threads which are provided along the back of the fabric.

This invention will now be further explained in the following more detailed specification of the weaving machine and the method according to this invention. The characteristics of the invention presented in this specification are purely illustrative, and can in no way be interpreted as a restriction on the protection claimed for this invention in the claims.

In this specification reference is made to the figures attached hereto, of which FIG. 1 is a schematic representation of the weaving bed which can move back and forth and the fixed weaving reed of the weaving machine.

Figure 4:
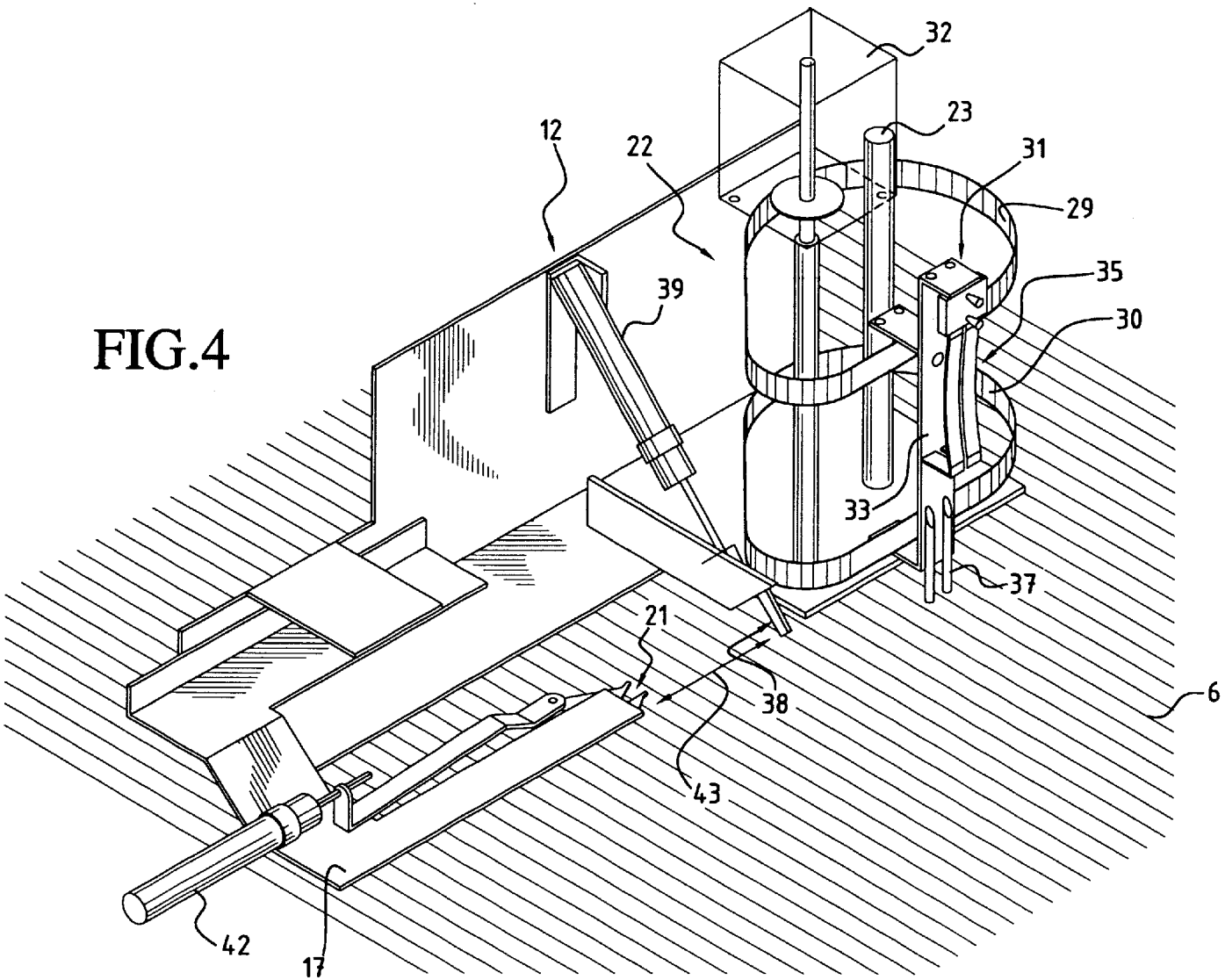

FIG. 4 up to and including 12 are schematic representations of the weaving sley in its successive locations during one operating cycle of the weaving machine.

Figure 1:
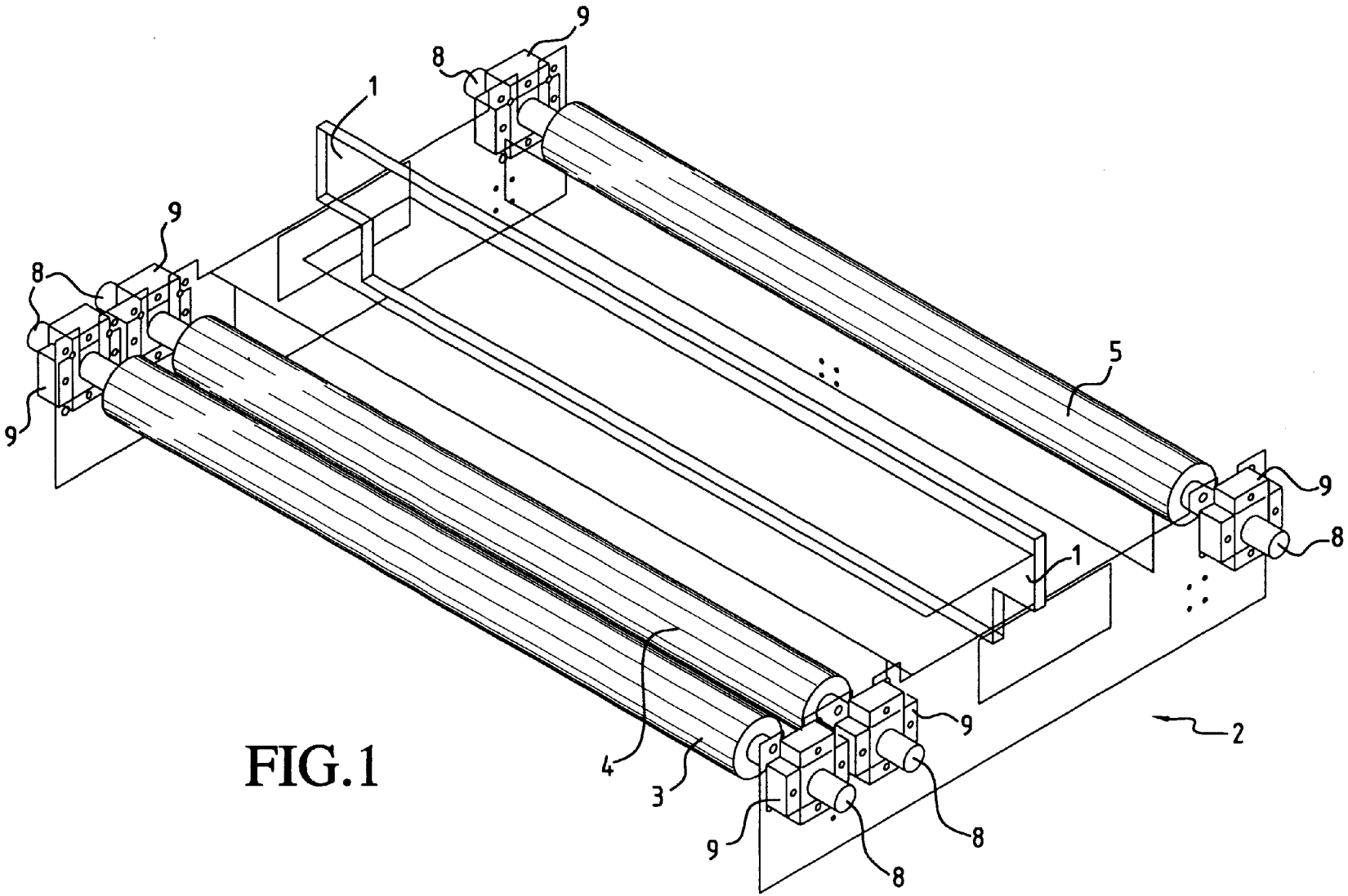

The weaving machine according to this invention comprises a chassis (not shown in the drawings) that comprises two upright side plates, between which a number of strengthening ribs are fitted. This chassis bears a fixed weaving reed (1) and a metal construction (2) which can move back and forth, called a weaving bed, consisting of iron sections and sheet work (see FIG. 1), which bears three rollers (3) (4) (5) extending according to the lateral direction of the chassis. on one side of the weaving reed (1)—the front—a first (3) and a second (4) roller are provided, which serve to unwind the warp threads (6), respectively the tensioning threads, therefrom during weaving. The roller (5) provided on the other side—the back—of the weaving reed (1) serves for rolling up the fabric formed during the operation of the weaving machine. The shaft (8) of each roller (3), (4), (5) is in the vicinity of each extremity mounted on bearings in a bearing house (9) attached to the construction (2).

The weaving bed (2) can move back and f forth, in a direction which is perpendicular to the weaving reed (1), by means of a cam which is driven by an electric motor with reduction (not shown in the drawings) . In each case after one or several weft threads have been inserted in a respective shed this electric motor is operated in order to move the weaving bed out of a starting position first forward (the side where the roller (3) for the warp threads is provided is considered as the front of the weaving machine), and subsequently backward again, back to the starting position. During the forward movement of the weaving bed (2) the warp threads, the tensioning threads and the already formed fabric move forward, while the weft threads are retained by the weaving reed (1), so that they slide backward in order to fit against the fell of the already formed fabric. This is called the beating-up of the weft threads.

Since the weaving reed (1) is here an immobile part of the weaving machine the space behind the weaving reed (1) can be utilized for other parts, such as will appear from the following.

Figure 2:
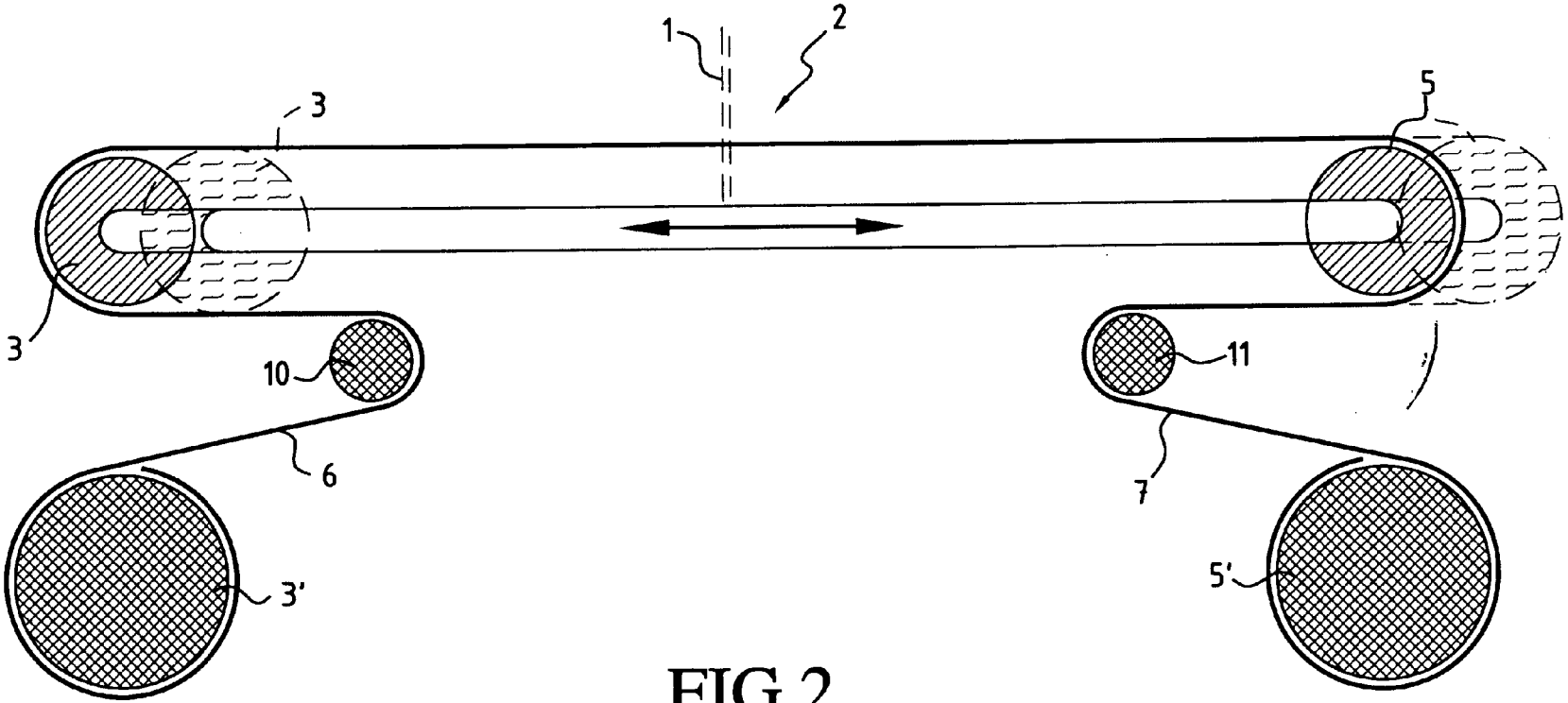
FIG. 2 illustrates the principle by means of a side elevation of a variant embodiment of the weaving bed which can move back and forth.

In an alternative embodiment the roller (3') which is provided for unwinding the warp threads (6), the roller which is provided for unwinding the tensioning threads, and the roller (5') which is provided for rolling up the fabric (7) are permanently attached, and the rollers (3), (4), (5) provided on the movable weaving bed (2) only serve for guiding the parts of respectively the warp threads (6), the tensioning threads and the fabric (7) which are in the vicinity of the weaving reed (1). The principle of this embodiment is illustrated by FIG. 2 (the roller for unwinding the tensioning threads and the roller (4) for guiding these tensioning threads is not represented herein). The rollers indicated in FIG. 2 by reference numbers (10) and (11) are fixed guide rollers for the warp threads (6), respectively the already formed fabric (7).

With such a weaving machine the beating-up of the weft threads can occur by only moving back and forth the last formed fabric part and the parts of the warp threads (6) extending in front of and behind the weaving reed (1) running toward this fabric part.

The weaving machine furthermore also comprises a weaving sley (12) which is movably disposed on a rail (13), which extends behind the weaving reed (1) over the entire width of the weaving machine, parallel to the weaving reed (1). On the weaving sley (12) a toothed wheel (14) is provided which meshes with a toothed rack (15) which runs parallel to the rail (13) over the entire width of the weaving machine. Through the rotation of the toothed wheel (15) by means of an electric motor (16) the weaving sley (12) can be positioned. The operation of this motor (16) occurs by means of a computer.

Figure 3:
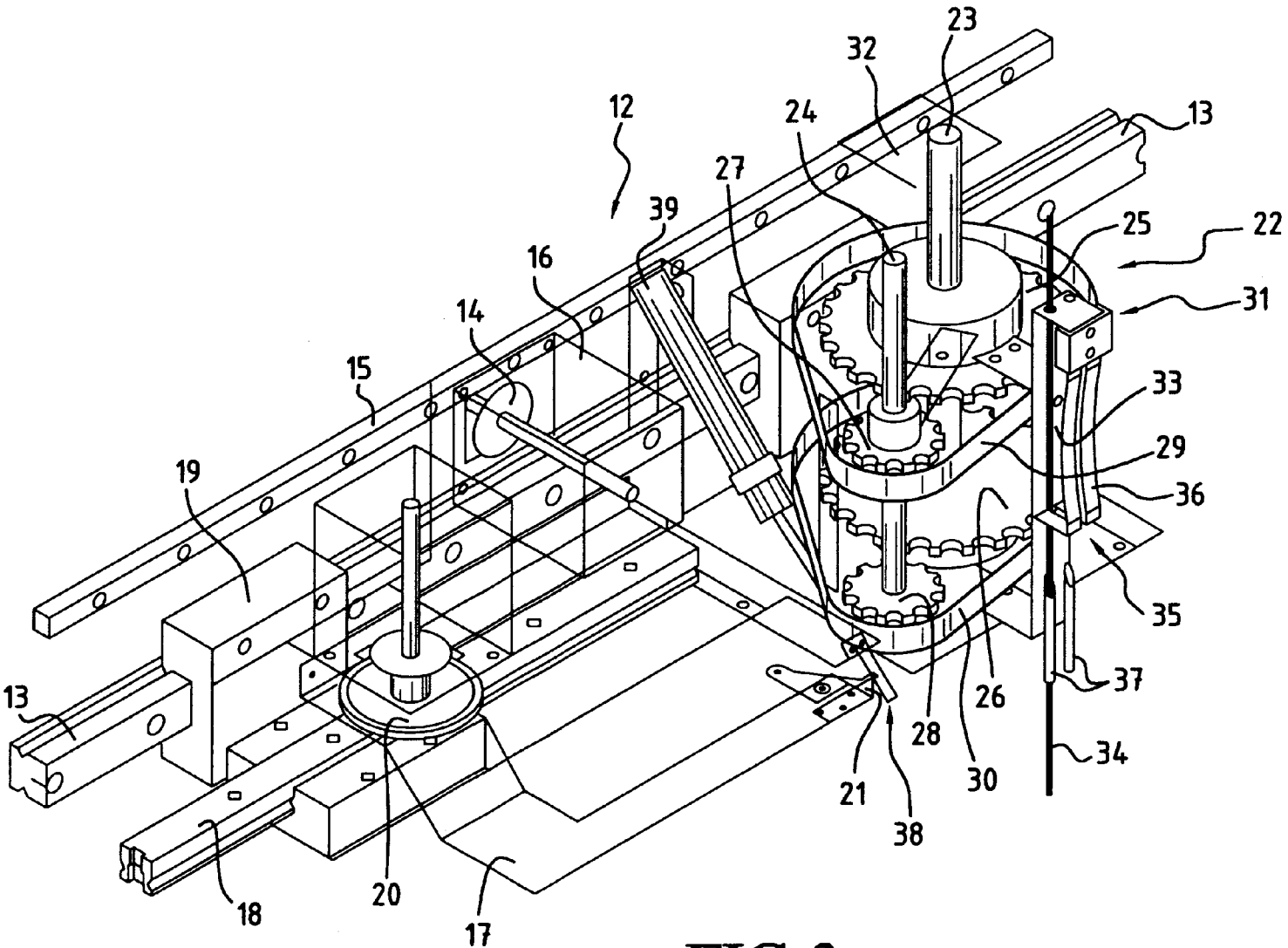
FIG. 3 is a schematic representation of a positionable weaving sley of the weaving machine.

On the weaving sley (12) a rapier (17) is provided which is movable on a guide rail (18) provided on the weaving sley (12). The rapier (17) can be moved by means of an electric motor (19), which drives a toothed wheel meshing with a toothed rack (not shown in FIG. 3). The operation of this motor (19) is also effected by means of a computer. On its extremity the rapier (17) has a gripping mechanism (21) that can be opened and closed by means of a small pneumatic cylinder (42) (shown in FIGS. 4–11 but not in FIG. 3).

On the weaving sley (12) a selection drum (22) is further provided. This comprises two vertical rotary shafts (23), (24) disposed next to one another. On each of these shafts two toothed wheels (25), (26); (27), (28) are provided, respectively in two horizontal planes located one above the other. A top endless chain (29) runs over the two top toothed wheels (25), (27), while a bottom endless chain (30) runs over the two bottom toothed wheels (26), (28). These chains (29), (30) bear a series of thread holders (31) (in FIGS. 3 through 11 in each case only one thread holder is represented), which extend almost vertically next to one another and form a row which extends over the entire revolution of the chain. Each thread holder (31) is connected to both chains (29), (30). By driving the top toothed wheels (25, 27) with the electric motor (32) provided for that purpose on the weaving sley (12) the top chain (29) rotates. The thread holders (31) are carried by this top chain (29), and these thread holders (31) in their turn also make the bottom chain (30) rotate. Because of this the row of thread holders (31), which in fact form a circle, can be rotated.

Each thread holder (31) can contain two weft threads (34), and comprise a vertical guide plate (33) along which these weft threads (34) can run next to one another in vertical direction. For each weft thread (34) the thread holder (31) comprises a thread tensioner (35) which comprises a spring element (36) that is provided in order to exert a downward directed tension on the weft thread (34) running along the guide plate (35). At the bottom the thread holder (31) has two vertical guide tubes (37). The weft threads (34) provided in the thread holder run through their respective guide tube (37) and have an end protruding below their guide tube (37).

In order to select a weft thread (34) the selection drum (22) is rotated until the weft thread (34) comes with its end protruding from the guide tube (37) into the selection position. The selection position is the position where the thread end can be gripped by the rapier (17). The electric motor (32) for rotating the selection drum (22) is operated by means of a computer.

On the weaving sley (12) a cutter mechanism (38) is also provided that can be operated by means of a small pneumatic cylinder (39). This cylinder (39) is also operated by the computer.

The weaving machine furthermore also still comprises a generally known jacquard mechanism (not represented in the figures) in order during successive operating cycles in progressive manner in each case to form the necessary shed between a part of the warp threads. The Jacquard mechanism is also operated by the computer.

During the manufacture of a fabric on this weaving machine in every operating cycle another part of pattern-forming weft thread is inwoven. The color of the weft thread, its length, and the location where it is inwoven, must moreover in each case correspond to the pattern that is to be made visible in the fabric. In order to achieve this for every operating cycle the required operating data must be available for the jacquard machine, the positioning motor (16) of the weaving sley (12), the motor (19) of the rapier, the motor (32) of the selection drum (22), the cylinder (42) of the gripping mechanism (21), and the cylinder (33) of the cutter mechanism (38), the electric motor of the weaving bed, and the electric motors of the warp thread rollers and the fabric roller.

The above mentioned driving means of the weaving machine are connected to a computer which in its turn can receive data from a scanner. An image of the pattern which is to be obtained in the fabric is input via the scanner, and the thus obtained pattern data are stored in a memory. The computer is programmed in order to process these pattern data automatically into the operating data and/or operating signals which are necessary in order to operate every driving means in every operating cycle at the correct moment in suitable manner.

The successive steps of the operation of the weaving machine during one operating cycle are represented in FIGS. 4 through 11.

Figure 5:
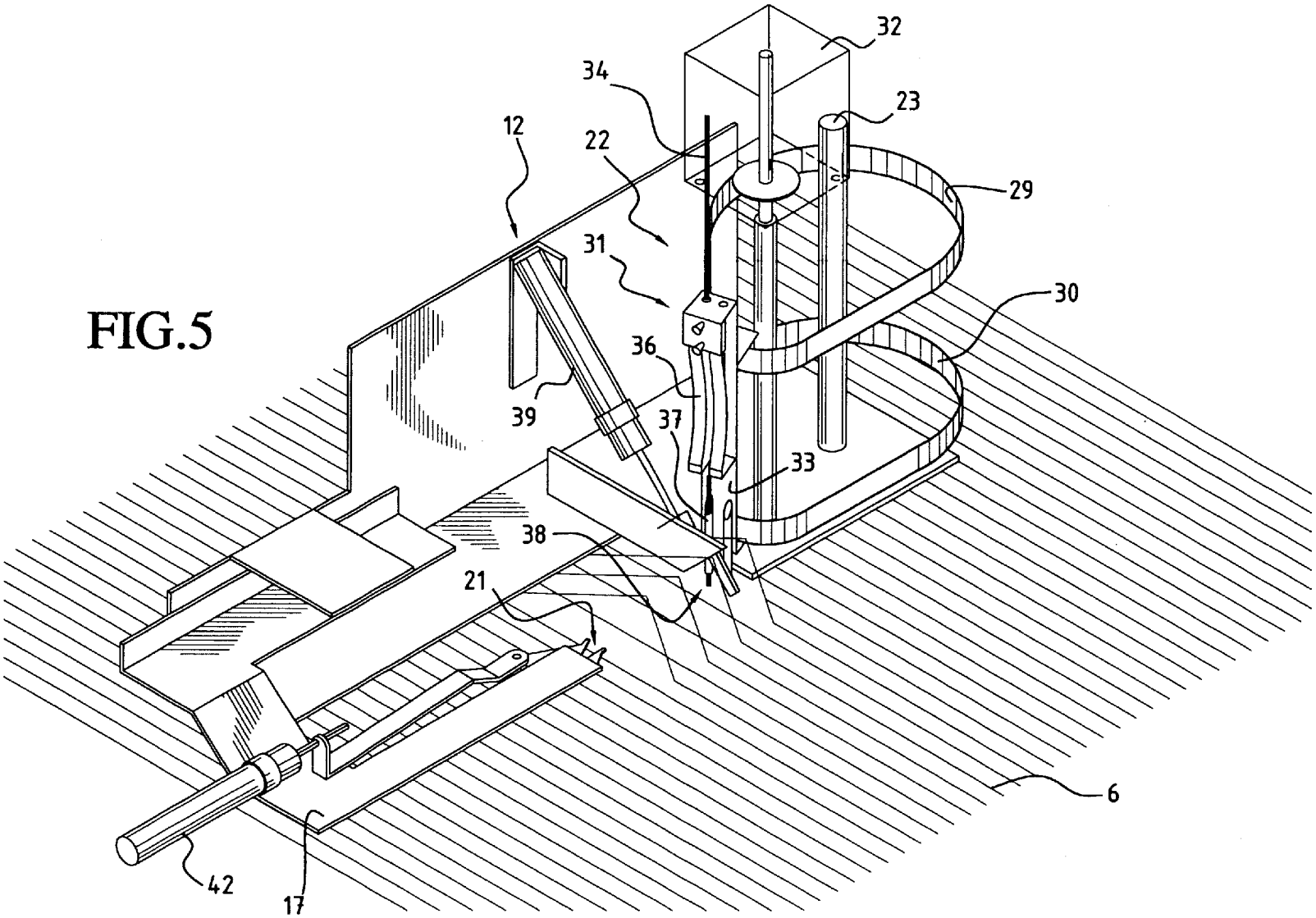
Figure 6:
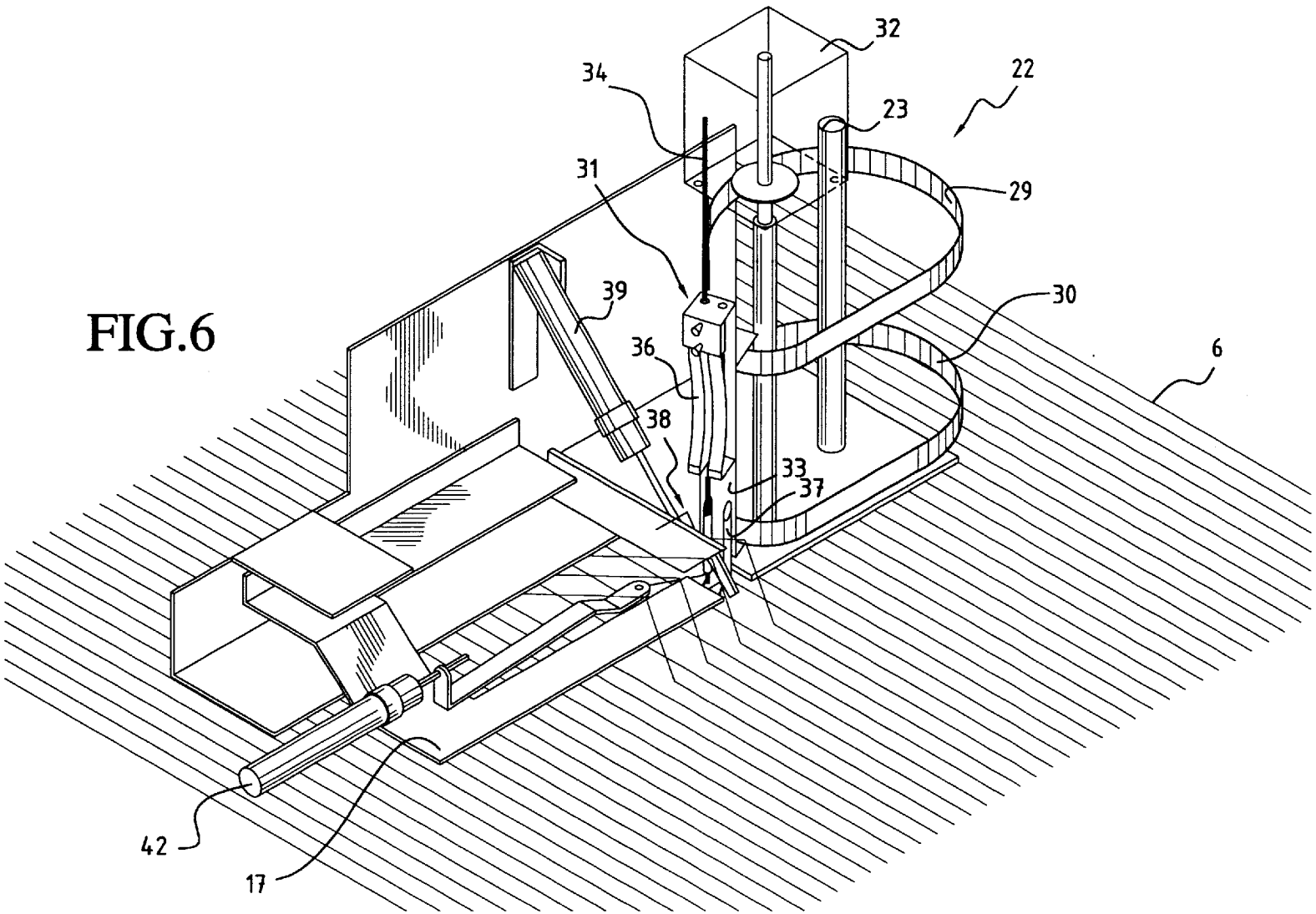
Figure 7:
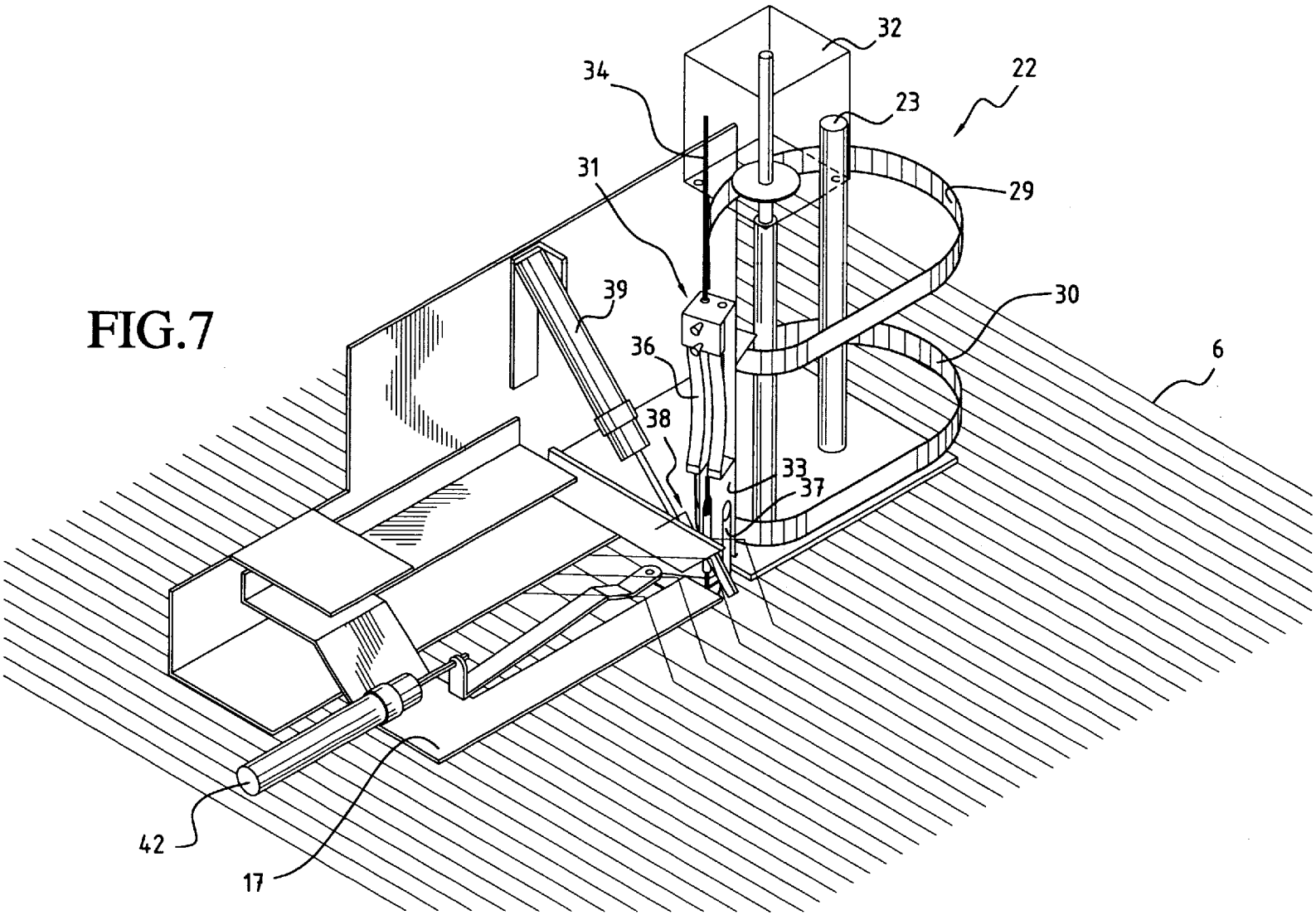
Figure 8:
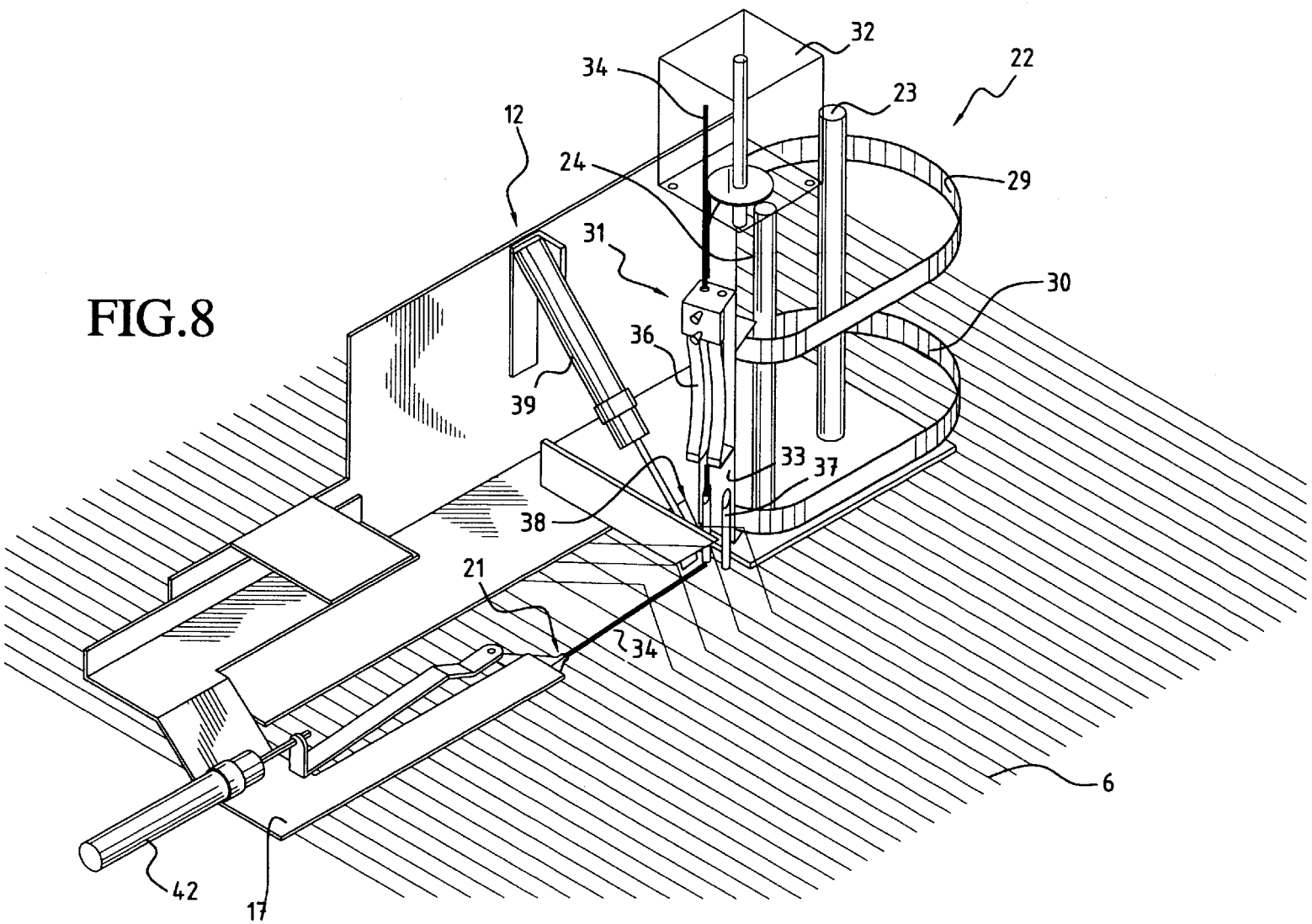
Figure 9:
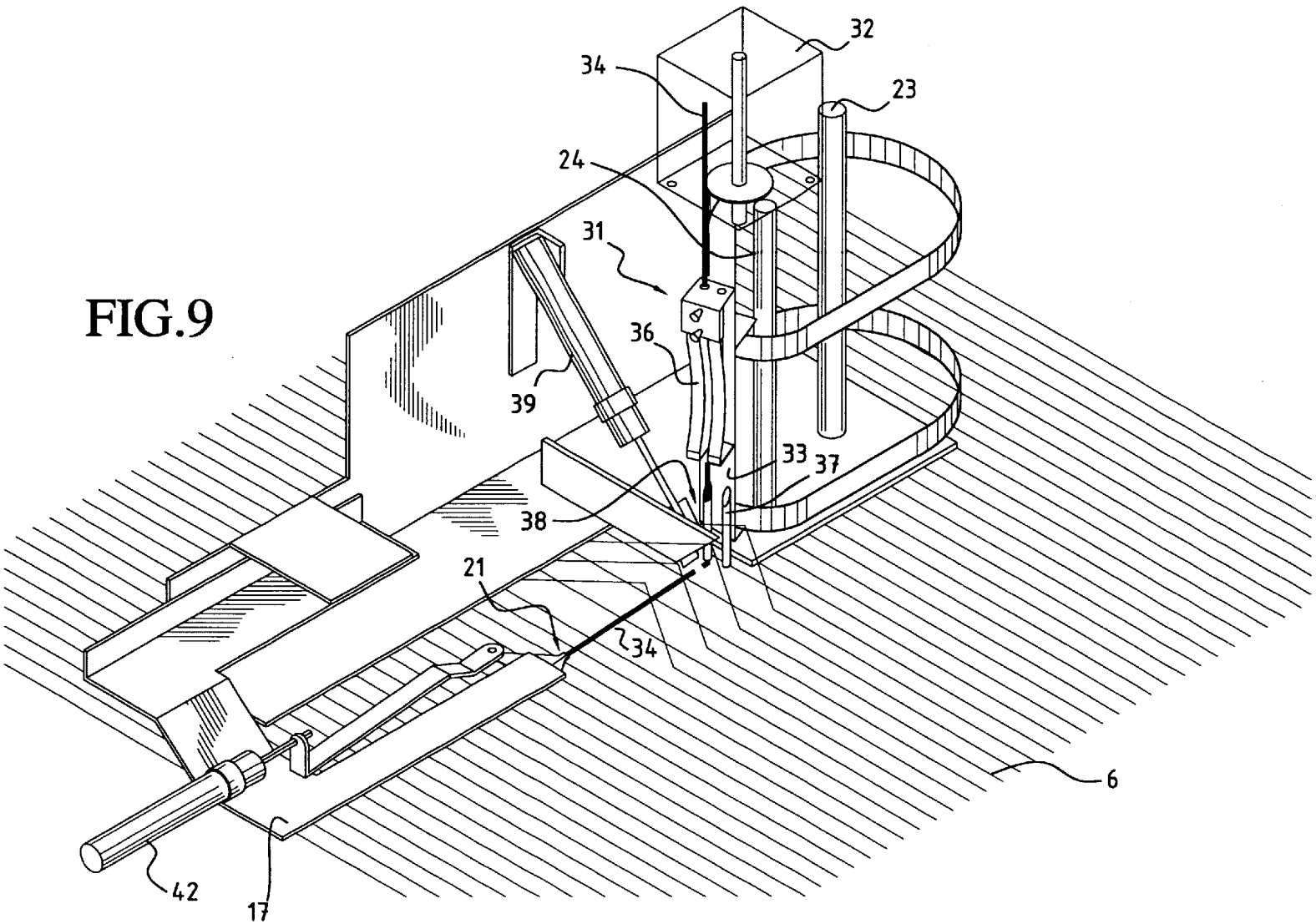
Figure 10:
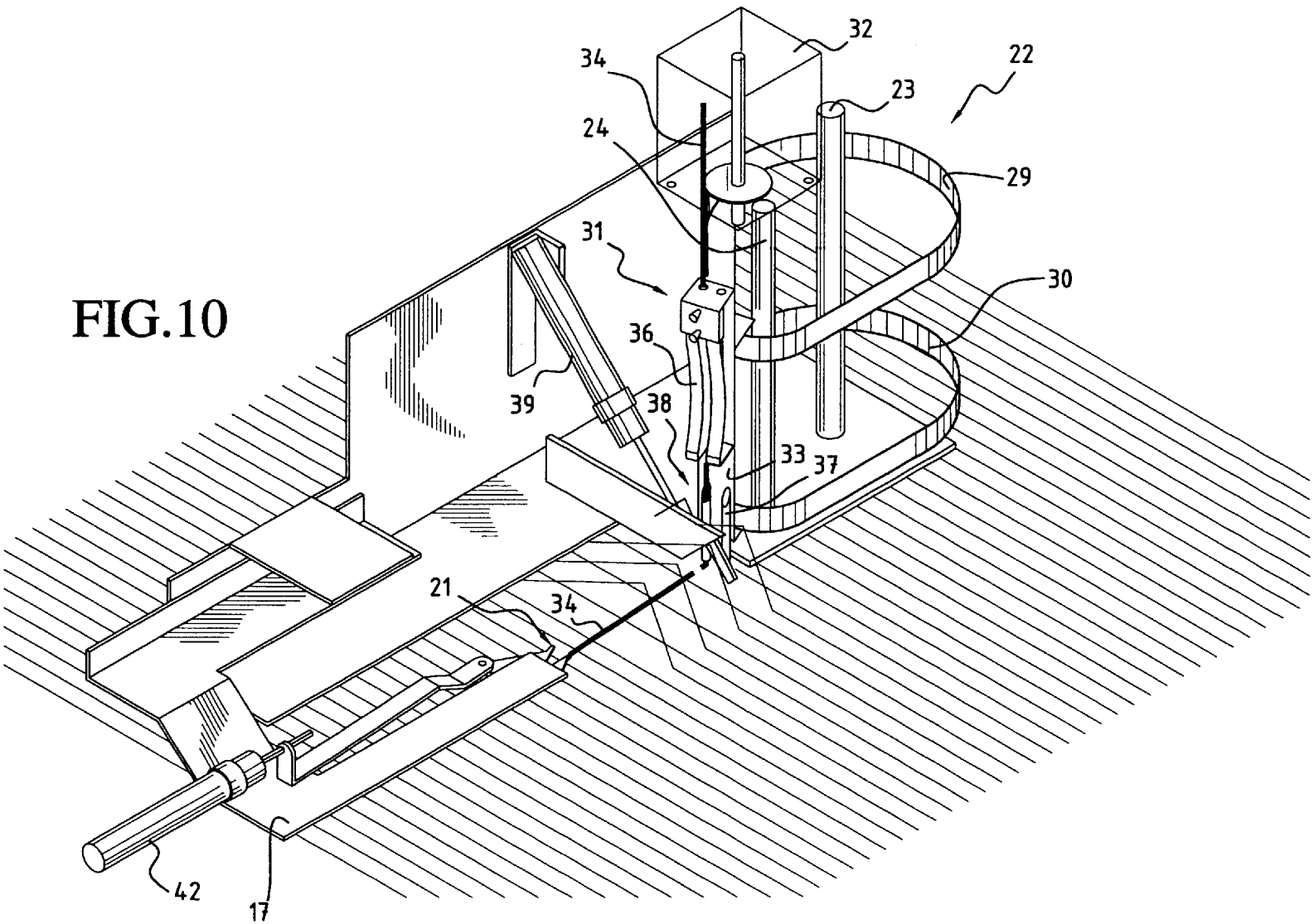

First the positioning motor (16) of the weaving sley (12) is operated in order so to position the weaving sley (see FIG. 4) that the warp threads (6) between which a shed must be formed are in the opening (43) (only shown in FIG. 4) between the gripping mechanism (21) and the cutter mechanism (38). Thereafter the electric motor (32) of the selection drum (22) is operated in order to bring the required weft thread into the selection position (FIG. 5).

Thereafter or simultaneously the jacquard mechanism is operated in order in known manner to form the required shed. Thereafter the electric motor (19) of the rapier (17) is operated in order to move it (with open gripper mechanism) into the shed until the extremity of the selected weft thread (34) protruding from the thread holder (31) is between the two parts of the opened gripping mechanism (21) (see FIG. 6). The pneumatic cylinder (42) of the rapier (17) is then operated in order to close the gripping mechanism (21) (see FIG. 7). Subsequently the electric motor (19) of the rapier (17) is operated in order to withdraw the rapier (17) out of the shed. Moreover the weft thread (34) held fast by the gripping mechanism (21) is pulled out of the yarn supply (not shown in the figures) via the thread holder (31) of the selection drum (22) (see FIG. 8). The rapier motor (19) is moreover operated in order to move the rapier (17) away from the selection drum (22) until the necessary length of the weft thread (34) has been pulled out of the selection drum (22).

Figure 11:
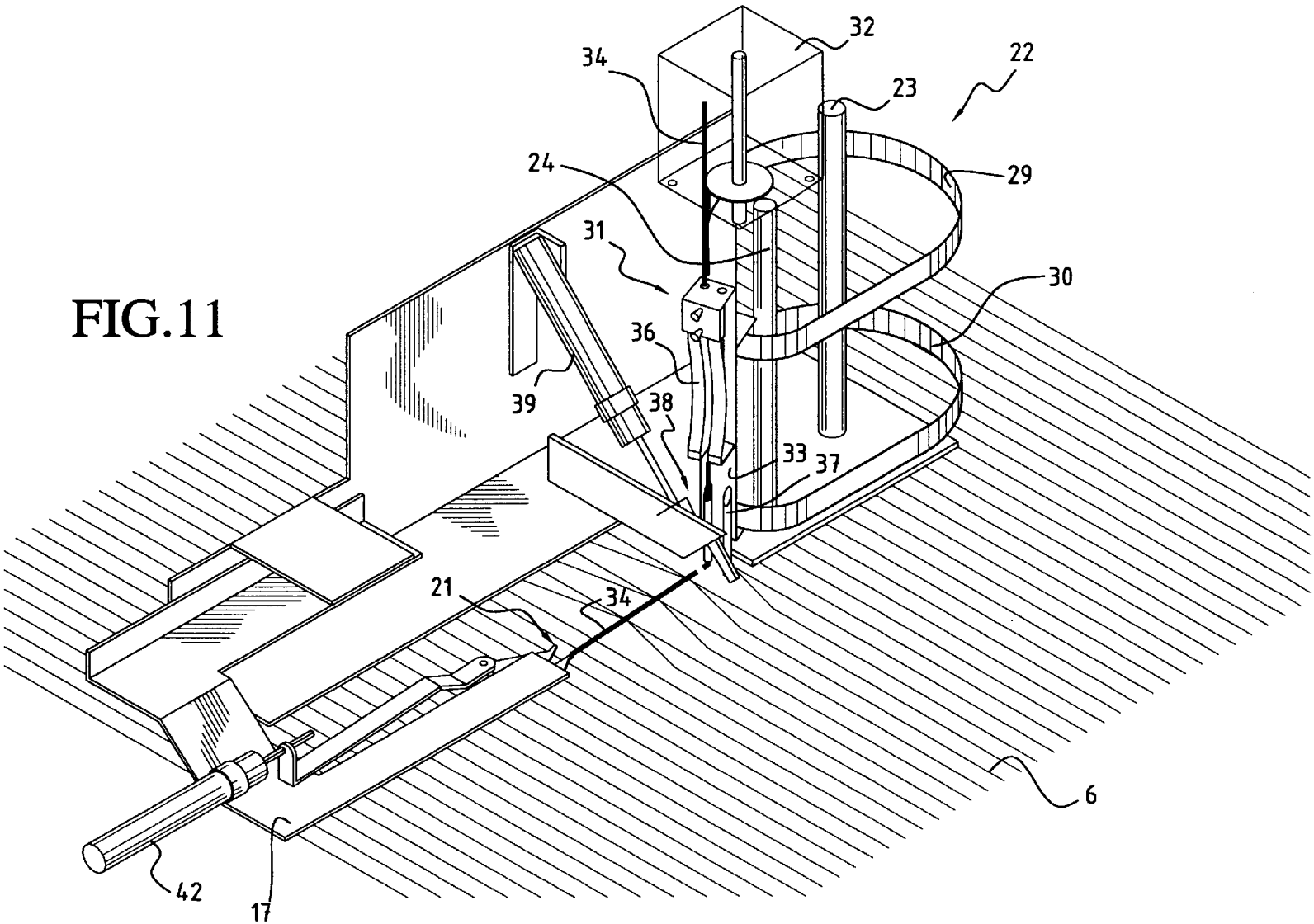

Thereafter successively the pneumatic cylinder (39) of the cutter mechanism (38) is operated in order to cut through the weft thread near its thread holder (31) (FIG. 9), the gripping mechanism (21) is opened by operating its pneumatic cylinder (42) (FIG. 10), and the jacquard mechanism is operated in order to close the shed (FIG. 11).

Subsequently the electric motor of the weaving bed (2) is operated in order to enable this weaving bed to perform a back and forth movement for beating up the e just inserted weft thread (34). In order to obtain a fabric of good quality preferably several back and forth movements are performed.

When all weft threads (34) of a specific weft line have been inserted the driving means of the roller (5), (5') on which the fabric (7) is rolled up—the cloth roller—is operated in order to pull the fabric slightly backward in order to enable the insertion of weft threads (34) in the following weft line. Of course the driving means of the rollers (3), (3'); (4) with warp threads (6) and tensioning threads must then also be operated in order to unwind a corresponding length of these threads.

Figure 12:
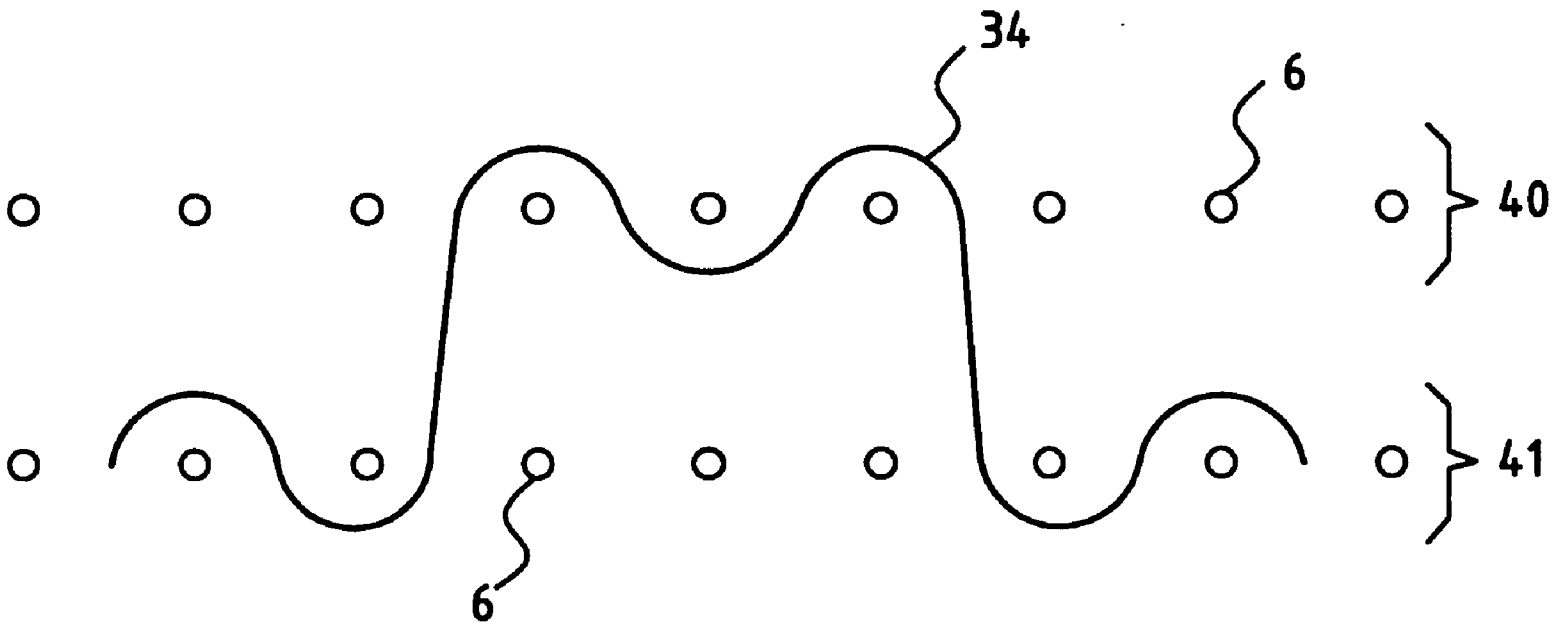

In order to obtain the typical gaps of Kelim and Gobelin fabrics between the neighboring weft threads of a weft line, and in order also to obtain a good inweaving of the weft threads, under the warp threads (6) which serve for the pattern-forming inweaving of the weft threads (34), and form a top layer (40), a bottom layer of warp threads (41) is provided (see FIG. 12), and each weft thread (34) is also non-pattern-formingly inwoven over a specific length by warp threads (6) of the bottom layer (41) on both sides of the part figure-formingly inwoven by warp threads (6) of the top layer (40).

A figure-formingly inwoven part of a weft thread (34) runs alternately above and below the successive warp threads (6) in the top layer (40). The more the weft thread (34) is figure-formingly inwoven over a shorter length by warp threads (6) of the top layer (40), the more a greater length of the weft thread (on both sides of the figure-forming part) will have to be inwoven by the warp threads (6) of the bottom layer (41) in order to obtain a proper inweaving. A part of a weft thread (34) inwoven into the bottom layer of warp threads (41) also runs alternately above and below the successive warp threads (6) of that layer (41).

When programming the computer in order to process pattern data into operating data or operating signals the processing can be allowed to take place per weaving point line. The weaving machine can be provided with several weaving sleys (12). In that case one weaving point line can be subdivided into as many areas as available weaving sleys and the pattern data for each area can be processed into separate operating data or operating signals (for each weaving sleys).

What is claimed is:

1. A selection drum for supply of weft thread to a desired position during manufacture of a fabric comprising, a plurality of vertical shaft member 23,24, having at least one toothed wheel 25,26,27,28 thereon for actuating at least one endless chain 29,30 which engages the toothed wheel, and a plurality of thread holders 31 for transmitting weft thread there through, the thread holders attached to the chain 29,30, whereby rotation of the vertical shaft members 23,24 causes the thread holders 31 to move in a closed path to supply the weft thread to a desired position during manufacture of a fabric.

2. A weaving sley comprising, a selection drum 22 for supply of weft thread during manufacture of a fabric, a rapier 17 operatively connected to the sley and movable relative to selection drum 22, the selection drum having a plurality of vertical shaft member 23,24, having at least one toothed wheel 25,26,27,28 thereon for actuating at least one endless chain 29,30 which engages the toothed wheel, and a plurality of thread holders 31 for transmitting weft thread there through, the thread holders attached to the chain 29,30, whereby rotation of the vertical shaft members 23,24 causes the thread holders 31 to move in a closed path to supply the weft thread to a desired position during manufacture of a fabric.

3. A weaving machine for manufacture of a fabric comprising, a jacquard device for forming a shed of warp threads, a weaving sley 12 having a selection drum 22 for supply of weft thread to the shed, a rapier 17 operatively connected to the weaving sley 12 and movable relative to selecting drum 22, the selection drum 22 having a plurality of vertical shaft member 23,24 having at least one toothed wheel 25,26, 27,28 thereon for actuating at least one endless chain 29,30 which engages the toothed wheel, and a plurality of thread holders 31 for transmitting weft thread there through, the thread holders attached to the chain 29,30, whereby rotation of the vertical shaft members 23,24 causes the thread holders 31 to move in a closed path to supply the weft thread to a desired position for manufacture of a fabric.

4. A method of manufacture of a fabric having weft threads comprising, forming a shed from a plurality of warp threads, and supplying a weft thread to the shed by selection drum 22, said selection drum comprising, a plurality of vertical shaft members 23, 24, having at least one toothed wheel 25, 26, 27, 28 thereon for actuating at least one endless chain 29, 30 which engages the toothed wheel, and a plurality of thread holders 31 attached to said chain 29, 30, whereby rotation of the vertical shaft members causes the thread holders to move to a desired position for supply of weft thread to the shed.

5. A selection device for supply of weft thread to a desired position during manufacture of a fabric comprising at least one rotatable element 25,26,27,28 and a plurality of thread holders 32 for transmitting weft thread there through, the thread holders being positioned in a row, whereby rotation of the rotatable element 25,26,27,28 causes said row to move for supply of weft thread to a desired position during manufacture of a fabric.

6. A weaving sley comprising a selection device 22 for supply of weft thread during manufacture of a fabric, a weft insertion mechanism operatively connected to the sley and movable relative to the selection device 22, the selection device comprising at least one rotatable element 25,26,27,28 and a plurality of thread holders 31 for transmitting weft thread there through, the thread holders being positioned in a row whereby rotation of a rotatable element 25,26,27,28 causes said row to move for supply of weft thread to a desired position during manufacture of a fabric.

7. A weaving machine for manufacture of a fabric comprising a shed-forming device for forming a shed of warp threads, a selection device 22 comprising at least one rotatable element and a plurality of thread holders 31 for transmitting weft thread there through, the thread holders being positioned in a row, whereby rotation of a rotatable element 25,26,27,28 causes said row to move for supply of weft thread to a desired position for manufacture of a fabric.

8. Weaving machine according to claim 7, characterized in that rotatable element (25), (26) (27), (28) moves the row of thread holders in a closed path.

9. Weaving machine according to claim 7, characterized in that the row of thread holders are carried by at least one endless carrier (29), (30), which is rotated by rotatable element (25), (26), (27), (28).

10. Weaving machine according to claim 7 comprising a weft mechanism (17–21, 38, 39, 42) to insert and cut off a length of weft thread (34) selected by the selection device (22) so that a fabric (7) is formed in which weft threads extend over a part of the fabric width and are pattem-formingly inwoven by warp threads (6).

11. Weaving machine according to claim 10, characterized in that the selection device (22) and the weft mechanism (17–21; 38, 39, 42) are provided on a positioning device (12).

12. Weaving machine according to claim 11, characterized in that the weft mechanism comprises a gripping means (17, 21) which, in relation to the positioning device (12), is movable in the weft direction, and the gripping means (17, 21) carries weft thread (34) selected by the selection device (22) and, through its movement in relation to positioning device (12), brings the weft thread (34) into the shed.

13. Weaving machine according to claim 10, characterized in that the weft mechanism (17–21, 38, 39, 42) also comprises a cutting means (38) to cut through the weft thread (34) brought into the shed between the shed and the selection device (22).

14. Weaving machine according to claim 7, characterized in that the weaving machine further comprises a weaving reed (1) that remains in a fixed position during the weaving, and a construction (2) which moves the last formed d fabric part together with the parts of the warp threads (6) extending therefrom through the reed in order to beat up one or several inwoven weft threads against already formed fabric part.

15. Weaving machine according to claim 7, characterized in that the weaving machine comprises a data processing unit and an input means for inputting pattern data into the data processing unit wherein the data processing unit uses the pattern data to determine any of the operating data or operating signals which are required for operating any of the shed-forming device, the selection device and the weft mechanism.

16. A method of manufacture of a fabric having weft threads comprising, forming a shed from a plurality of warp threads, and supplying a weft thread to the shed by a selection device 22, said selection device comprising at least one rotatable element 25,26,27,28 and a plurality of thread holders 31 for transmitting weft thread there through, the thread holders being positioned in a row whereby rotation of the rotatable element causes the thread holders to move to a desired position for supply of weft thread to the shed.

17. Method for manufacturing a fabric according to claim 16 wherein selection device (22) selects a weft thread (34) from a number of different weft thread s and a weft mechanism (17–21, 38, 39) inserts and cut s off a length of the selected weft thread (34) in the shed, so that the weft threads, extending over part of the fabric width, a re inwoven by the warp threads (6).

18. Method for manufacturing a fabric according to claim 17, wherein the shed-forming device, the selection device (22) an d the weft mechanism (17–21, 38, 39, 42) cooperate to form a shed of warp threads (6) and to select a weft thread (34) and the selected weft thread (34) is brought into the shed, whereby warp threads (6), weft thread (34) and the length of the selected weft thread (34) are selected so that the selected weft threads are inwoven by the warp threads (6) to form a predetermined pattern in the fabric.

19. Method for manufacturing a fabric according to claim 16 characterized in that pattern data are input into a data processing unit and the data processing unit uses the pattern data to determine any of the operating data or operating signals which are required for forming the shed and selecting the weft thread.

20. Method for manufacturing a fabric according to claim 16 characterized in that every weft thread is inwoven on both sides of a pattern-forming part by warp threads (6) which are provided along the back of the fabric.

21. Method for manufacturing a fabric according to claim 16 characterized in that one or more inwoven weft threads are beat up against an already formed fabric part by moving a last formed fabric part together with parts of the warp threads extending therefrom towards a weaving reed (1) while the weaving reed (1) stands still.

* * * * *